US006927750B1

(12) United States Patent
Song

(10) Patent No.: US 6,927,750 B1
(45) Date of Patent: Aug. 9, 2005

(54) EXTERNAL DISPLAY DEVICE OF REFRIGERATOR AND METHOD FOR CONTROLLING THE SAME

(75) Inventor: Jun Il Song, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 08/984,059

(22) Filed: Dec. 3, 1997

(30) Foreign Application Priority Data

Dec. 3, 1996 (KR) ..... 96-61243

(51) Int. Cl.[7] ..... G09G 3/04
(52) U.S. Cl. ..... 345/34; 345/48; 62/156
(58) Field of Search ..... 345/211, 212, 213, 345/214, 215, 34, 48, 33; 62/126, 127; 370/445–457; 63/156

(56) References Cited

U.S. PATENT DOCUMENTS 4,205,200 A * 5/1980 Parikh et al. ..... 370/472
4,254,472 A * 3/1981 Juengel et al. ..... 702/188
4,418,262 A * 11/1983 Noda ..... 219/10.55
4,512,026 A * 4/1985 Vander Meiden ..... 370/514
4,536,759 A * 8/1985 DiMassimo et al. ..... 345/34
4,646,528 A * 3/1987 Marcade et al. ..... 62/127
4,729,126 A * 3/1988 Olek ..... 379/22
4,821,530 A * 4/1989 Ledbetter ..... 62/332
4,947,317 A * 8/1990 DiGiulio et al. ..... 370/305
5,136,865 A * 8/1992 Aoki et al. ..... 62/126
5,150,359 A * 9/1992 Wilson et al. ..... 370/438
5,237,322 A * 8/1993 Heberle ..... 340/825.52
5,265,431 A * 11/1993 Gaudet et al. ..... 62/55.5
5,555,189 A * 9/1996 Yamazato et al. ..... 174/47
5,600,310 A * 2/1997 Whipple et al. ..... 307/11
5,616,269 A * 4/1997 Fowler et al. ..... 219/720
5,748,684 A * 5/1998 Sanchez ..... 370/509
5,835,785 A * 11/1998 Overtoom et al. ..... 710/110
5,848,072 A * 12/1998 Prill et al. ..... 370/471
5,939,974 A * 8/1999 Heagle et al. ..... 340/286.09

* cited by examiner

*Primary Examiner*—Guy J. Lamarre
*Assistant Examiner*—Fritz Alphonse
(74) *Attorney, Agent, or Firm*—Birch, Stewart, Kolasch & Birch, LLP

(57) ABSTRACT

An external display device of a refrigerator which includes a microprocessor enabling a serial data transmission/reception between the external display device and a control unit included in the refrigerator. The microprocessor is coupled with a second microprocessor included in the control unit by two voltage supply lines and a minimum number of data transmission lines. Data transmission/reception between the two microprocessor is carried out in an asynchronous serial manner while using an appropriate data format so that each microprocessor recognizes the operation condition of the counter microprocessor. Accordingly, it is possible to simplify the configuration of signal lines required between the external display device and control unit, irrespective of the complexity of functions required. By virtue of the simplified signal line configuration, it is possible not only to reduce costs, but also to reduce the amount of work required in the passing of signal lines through a hinge hole to couple the external display device to the control unit.

10 Claims, 8 Drawing Sheets

EXTERNAL DISPLAY DEVICE OF REFRIGERATOR AND METHOD FOR CONTROLLING THE SAME

BACKGROUND OF THE INVENTION

1. Field of the Invention

The present invention relates to an apparatus for and a method of externally displaying the operating state of a refrigerator, and more particularly to an external display device of a refrigerator which is configured to achieve a serial data transfer with a control unit of the refrigerator. Also, the present invention relates to a method for controlling such an external display device.

2. Description of the Conventional Art

Home electronic appliances such as refrigerators are widely used by a variety of consumers having a variety of tastes. In order to satisfy such a variety of tastes of consumers, manufacturers of such home electronic appliances manufacture appliances having multiple functions.

For example, in the case of refrigerators, many development efforts have been made to add auxiliary functions to the basic functions of a refrigerator, or to provide a function for selectively using the basic functions of the refrigerator, thereby providing a power saving function to the refrigerator.

One such auxiliary function is to display information associated with the current operating state of a refrigerator or other states, thereby enabling a user to recognize those states. The present invention relates to an external display device having such a function.

The externally displayed information may include the current temperature and set temperature of a refrigerating or freezing compartment, an indicator based on the amount of generated cold air, the use or non-use state of the refrigerating or freezing compartment or a fresh compartment, and erroneous states of elements required for a freezing cycle.

Problems involved in conventional external display devices employed in refrigerators will now be described.

FIG. 1 is a block diagram illustrating the configuration of a refrigerator to which a conventional external display device is applied.

As shown in FIG. 1, the refrigerator includes sensors S1 and S2 adapted to sense the temperature of a refrigerating or freezing compartment, a compressor 16 used in the freezing operation of the refrigerator, a fan motor 17 operatively connected to the compressor 16 and adapted to circulate cold air through the refrigerating or freezing compartment, and a defrosting heater 18 adapted to remove frost formed before and after the freezing operation.

The refrigerator also includes a microprocessor 12 for controlling operations of the compressor 16, fan motor 17 and defrosting heater 18 in accordance with temperatures detected by the sensors S1 and S2, buffers 13 and 14 for temporarily storing data output from the microprocessor 12, and ten signal lines L1 to L10 for transmitting data output from the buffers 13 and 14 in a parallel manner to an external display device 20.

The microprocessor 12 and buffers 13 and 14 constitute a control unit 10, along with another buffer 15 which will be described hereinafter.

As shown in FIG. 2, the external display device 20 is mounted on the outer surface of a refrigerator door. The external display device 20 is configured to display a key manipulation of the user and the current state of the refrigerator. This external display device 20 includes a plurality of light emitting elements LED1 to LEDn, and a plurality of diodes D1 to Dm. These light emitting elements LED1 to LEDn and diodes D1 to Dm are connected in a combined manner to the signal lines L1 to L10 adapted to transmit data output from the control unit 10. For example, the light emitting element LED1 is coupled between the first and seventh signal line L1 and L7 whereas the light emitting element LED2 is coupled between the second and seventh signal line L2 and L7.

Accordingly, the light emitting elements LED1 to LEDn turn on selectively, to perform a light emitting operation, in accordance with parallel data from the buffers 13 and 14 applied thereto via the ten signal lines L1. The diodes D1 to Dm turn on selectively by the parallel data applied thereto.

The external display device 20 also includes a plurality of keys K1 to K12. These keys K1 to K12 are connected to signal lines in a manner similar to that in the case of the light emitting elements LED1 to LEDn. For example, the key K1 is coupled between the first and eleventh signal lines L1 and L11 whereas the key K2 is coupled between the first and twelfth signal lines L1 and L12.

The diodes D1 to Dm serve to prevent backward current from being generated.

When one of the keys K1 to K12 is selected by the user, a key signal in the form of voltage is generated. This key signal is sent to the microprocessor 12 which, in turn, detects the selected key based on the key signal.

The signal lines L11 and L12 are also included in the external display device 20 in order to transmit key signals generated from selected keys to the control unit 10. The external display device 20 further includes a buffer 15 for temporarily storing key signals received from the signal lines L11 and L12 and then outputting the key signals to the microprocessor 12.

A supply voltage source 11 is also provided to supply a drive voltage to the microprocessor 12.

FIG. 2 is a perspective view illustrating the outer construction of a general refrigerator in which the external display device 20 is installed.

As shown in FIG. 2, the external display device 20 is mounted on the outer surface of a refrigerator door 25 hingably mounted to a refrigerator body by a hinge. The control unit 10, which serves to control the operation of the refrigerator, is mounted in the inner portion of the refrigerator body. The control unit 10 also serves to control the external display device 20.

The external display device 20 is coupled to the control unit 10 by signal lines L1 to L12. The signal lines L1 to L12 extend through a hinge hole 31 formed at the hinge.

Signal processing operation of the external display device having the above-mentioned configuration will now be described.

The light emitting operation of the light emitting elements LED1 to LEDn based on data output from the microprocessor 12 will be described first.

When the microprocessor 12 receives signals from the sensor S1 and S2 indicative of the temperature of a refrigerating or freezing compartment, it determines the state of the refrigerator, and then controls operations of the compressor 16, fan motor 17 and defrosting heater 18 in accordance with an appropriately set program.

The microprocessor 12 also sends data to be displayed, such as the compartment temperature or current operation state of the refrigerator, to the external display device 20 via a selected one of output terminals OUT1 to OUT10 in the form of a signal of a certain voltage level.

The output signal is temporarily stored in the buffers 13 and 14 and then transmitted to the external display device 20 mounted on the refrigerator door 25 via a selected one of the signal lines L1 to L10. Based on the transmitted signal, a selected one of the light emitting elements LED1 to LEDn emits light.

As the selected light emitting element emits light in accordance with the above-mentioned procedure, the data output from the microprocessor 12 is displayed, so that the user can recognize the current state of the refrigerator. In this case, the display operation of the external display device 20 is carried out irrespective of a key manipulation of the user. In other words, this case corresponds to a case in which the microprocessor 12 operates to display information about the operating state of the refrigerator, etc. in accordance with a program set therein. The information may include the refrigerating or freezing compartment temperature detected by the sensors S1 and S2, and an indicator indicating the amount of generated cold air.

Now, a signal transmission procedure will be described which initiates the point of time when the user manipulates an optional key on the external display device 20 to when the microprocessor 12 of the control unit 10 detects the selected key.

The microprocessor 12 sequentially outputs high-level signals at its output terminals in such a manner that there is no data collision in the signal lines L1 to L12 along which data inputting/outputting is carried out. The outputting of a high-level signal is carried out under the condition in which the microprocessor 12 recognizes the output line to which the signal is transmitted.

When the user selects an optional key on the external display device 20, a current path is established between the selected key and the microprocessor 12 via one of the eleventh and twelfth signal lines L11 and L12. Accordingly, the signal output from the microprocessor 12 flows along the established current path, so that it is fed back as an input key signal to the microprocessor 12 via the signal line L11 or L12. Based on the input key signal, the microprocessor 12 detects the selected key.

Where the input key signal is associated with a certain control, the microprocessor 12 carries out the control. Where the input key signal is associated with a display of certain information, the microprocessor 12 detects the state of the refrigerator associated with the information to be displayed and outputs a signal for driving light emitting elements selected to display the information. The outputting of the signal is carried out in the same manner as mentioned above.

Thus, information according to the key selected by the user is displayed on the display panel of the external display device 20.

Therefore, in accordance with the external display device of the refrigerator, the user can recognize the operating state of the refrigerator without opening the door of the refrigerator. It is also possible to apply a signal for adjusting the operating state of the refrigerator to the control unit of the refrigerator without opening the door of the refrigerator.

However, the above-mentioned conventional external display unit uses a parallel communication system for communications between the external display unit and control unit. Due to the use of such a parallel communication system, an increase in the number of functions to be displayed results in an increase in the number of signal lines to transmit signals associated with those functions. However, such an increase in the number of signal lines is problematic.

As shown in FIG. 2, the signal lines L1 to L12, which are used to transmit signals between the control unit 10 mounted in the refrigerator body and the external display device 20 attached to the outer surface of the refrigerator door, extend through the hinge hole 31 of the hinge 30. In such a configuration, an increase in the number of signal lines results in a difficulty in inserting those signal lines into the hinge hole 31. Furthermore, the limited size of the hinge hole 31 limits the number of signal lines that can be inserted into the hinge hole 31. This results in a limitation in the quantity of data that can be displayed on the external display device 20.

Where the external display device 20 is spaced apart from the control unit 10 by a great distance, signal lines having a great length must be used. This results in an increase in manufacturing costs.

SUMMARY OF THE INVENTION

Therefore, an object of the invention is to provide an external display device of a refrigerator having a configuration capable of achieving a desired data transmission while using a minimum number of signal lines, having a minimum length, and a method for controlling the external display device.

In accordance with one aspect, an embodiment of the present invention provides an external display device of a refrigerator comprising: a display unit mounted on an outer case of the refrigerator, the display unit recognizing put and converting the recognized key input into serial data, while decoding a display control signal indicative of an operating state of the refrigerator and executing a display operation based on the decoded signal; control means for converting the display control signal into serial data and outputting the converted display control signal, while decoding a key signal received from the display unit and executing a control based on the decoded key signal; and data signal line means adapted to transmit data between the display unit and the control means in a serial manner.

In accordance with another aspect, the present invention provides a method for controlling an external display device of a refrigerator adapted to display an operating state of the refrigerator while enabling a key selection for controlling the refrigerator, comprising the steps of: determining whether a right of data transmission is assigned to the external display device or to a control unit of the refrigerator; converting, into serial data, a signal indicative of an operation state of the refrigerator when the data transmission right is assigned to the control unit while converting, into serial data, a key input signal when the data transmission right is assigned to the external display device, and outputting the resultant data; and inputting the output data, decoding the data, and executing a control based on the decoded data.

In accordance with the embodiment of the present invention, both the control unit of the refrigerator and the external display device have control means for controlling data transmission/reception.

The data transmission/reception by the control means is carried out in a serial manner. In particular, the data transmission/reception is carried out in an asynchronous serial data transmission manner using three or four lines or in a synchronous serial data transmission manner using five lines.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
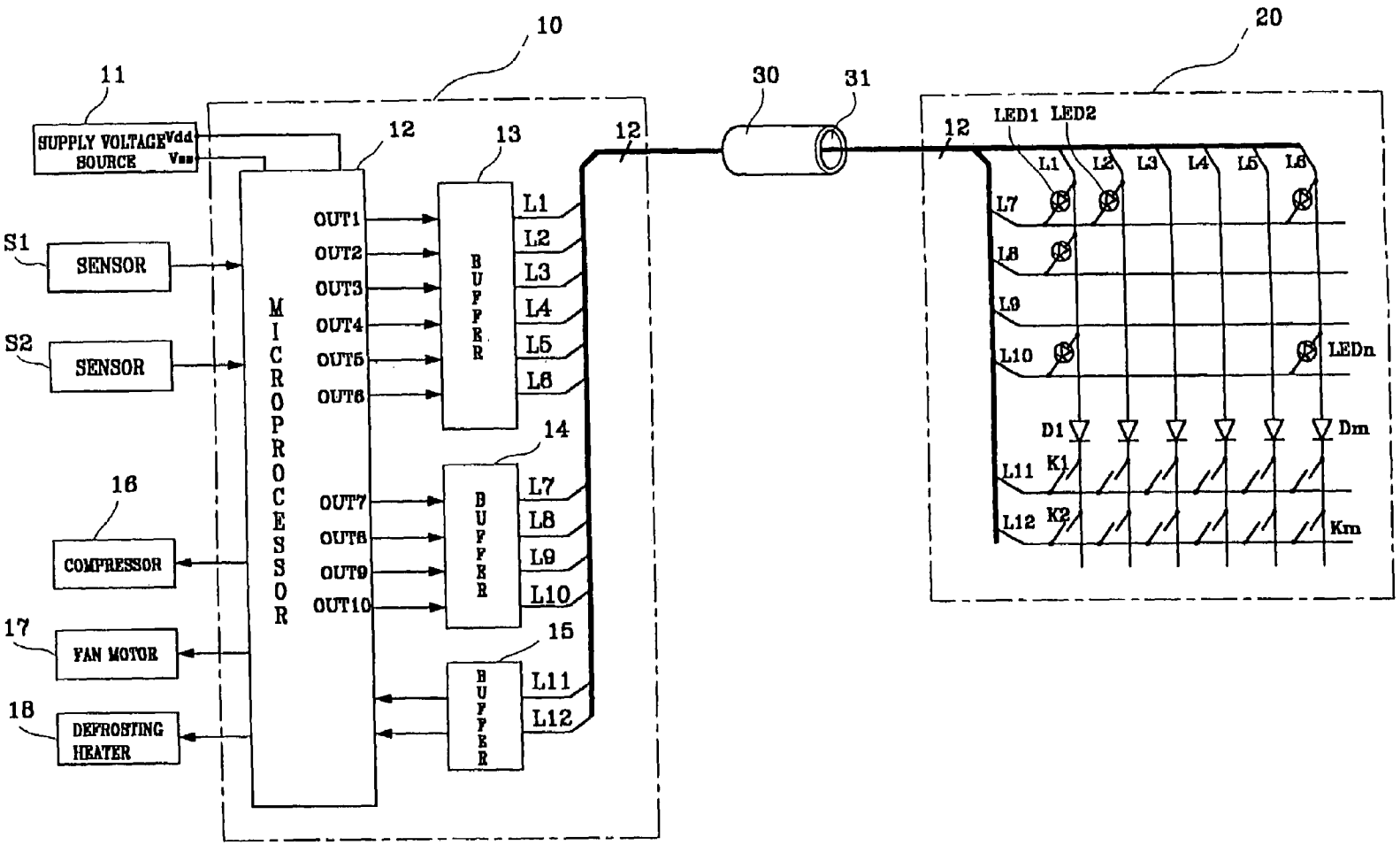
FIG. 1 CONVENTIONAL ART
FIG. 1 is a block diagram illustrating the control circuit configuration of a refrigerator to which a conventional external display device is applied.
Figure 2:
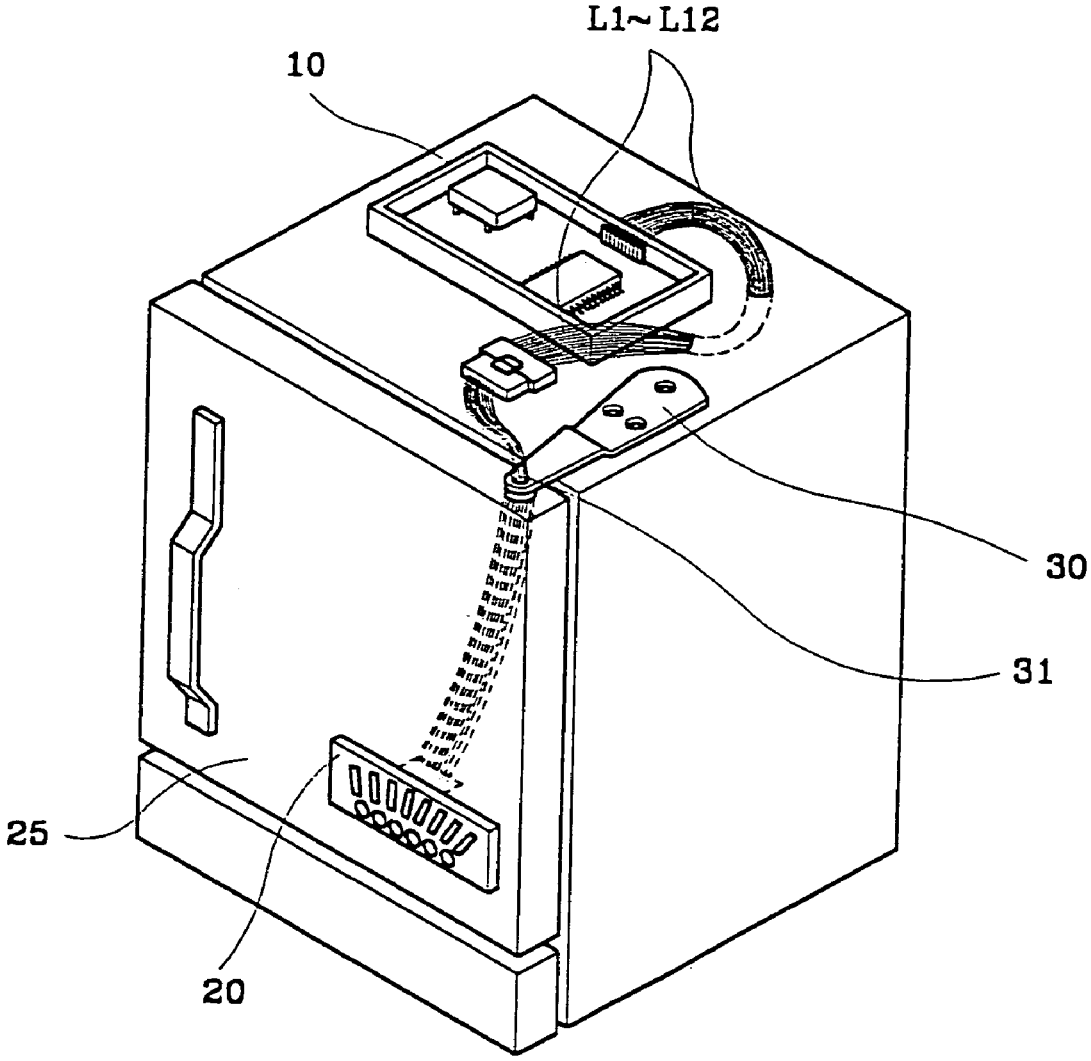
FIG. 2 CONVENTIONAL ART
FIG. 2 is a perspective view illustrating a general refrigerator to which the conventional external display device is applied.
Figure 3:
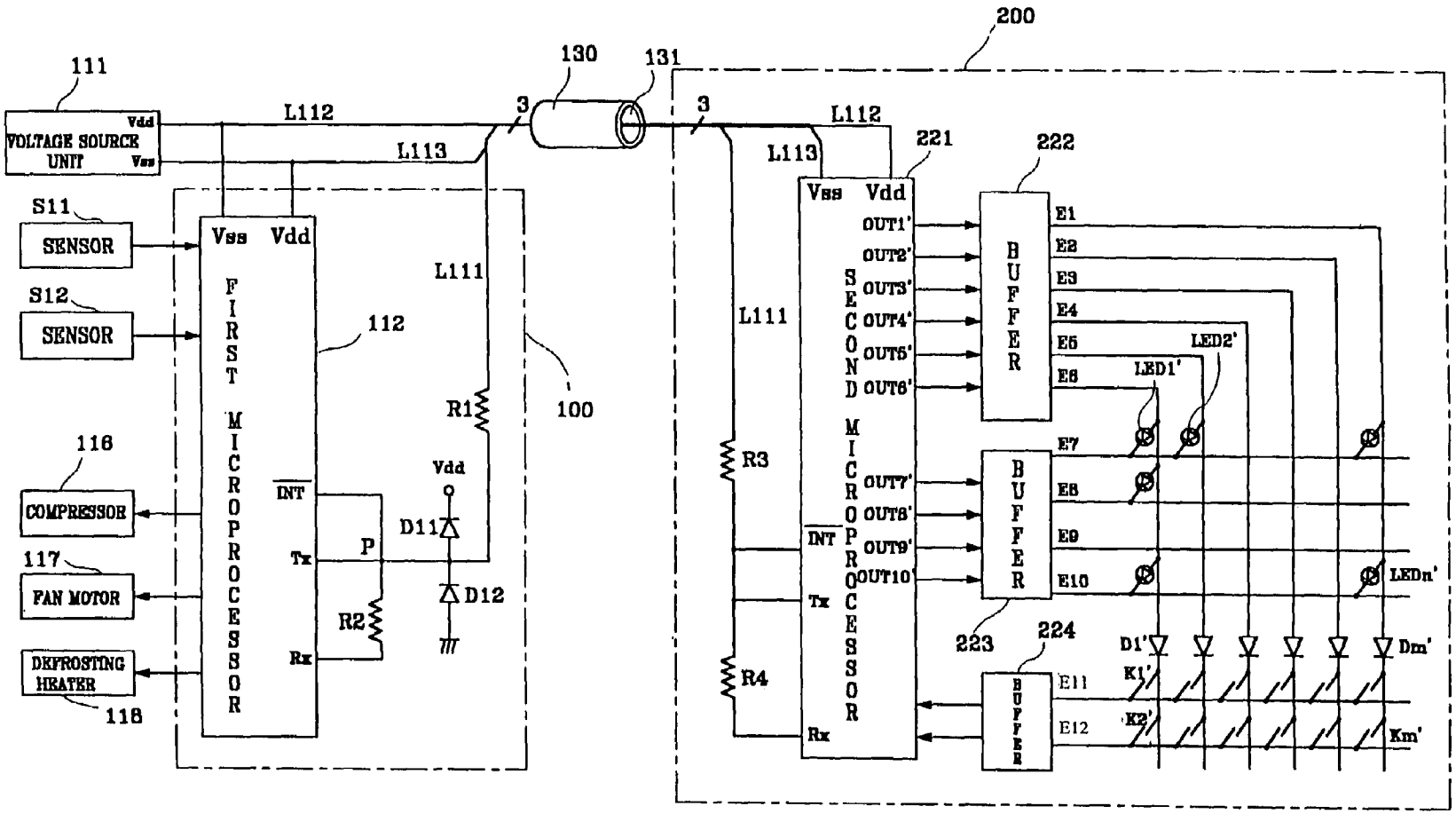
FIG. 3 is a block diagram illustrating the control circuit configuration of a refrigerator to which an external display device according to an embodiment of the present invention is applied.

Referring to FIG. 3, the configuration of a refrigerator to which an external display device according to a first embodiment of the present invention is described.

The portion of the configuration shown in the left portion of FIG. 3 corresponds to a configuration for operating the refrigerator and controlling this refrigerator operation. First, this configuration will be described.

As shown in FIG. 3, the refrigerator includes sensors S11 and S12 respectively adapted to sense the temperature of a refrigerating or freezing compartment, a compressor 116 operating for a freezing operation of the refrigerator, a fan motor 117 operatively connected to the compressor 116 and adapted to circulate cold air through the refrigerating or freezing compartment, and a defrosting heater 118 adapted to remove frost formed before and after the freezing operation.

The refrigerator also includes a first microprocessor 112 for controlling operations of the compressor 116, fan motor 117 and defrosting heater 118 in accordance with temperatures detected by the sensors S1 and S2. The first microprocessor 112 has an output terminal Tx for outputting data in a serial manner and an input terminal Rx for receiving data in a serial manner. Another output terminal INT is also provided at the first microprocessor 112. An interrupt signal is output at the output terminal INT. Normally, the first microprocessor 112 outputs a high-level signal at the output terminal INT. When the first microprocessor 112 outputs data at its output terminal Tx or receives data at its input terminal Rx, it inverts the signal output at its output terminal INT from a high level to a low level, thereby outputting an interrupt signal informing of the generation of an interruption.

The three input/output terminals Rx, Tx and INT of the first microprocessor 112 are coupled together at a node P. The node P is coupled to a first signal line L111 adapted to transmit data between the first microprocessor 112 and the external display device 200, which is decribed later. The node P is also coupled to a pair of diodes D11 and D12 and a pair of resistors R1 and R2. The diodes D11 and D12 are connected in the same direction between a supply voltage Vdd and a ground voltage.

The first signal line L111, which is a data signal line, extends through a hinge hole 131 of a hinge 130 mounted to a refrigerator body of the refrigerator so that it is connected to the external display device 200.

The refrigerator further includes a voltage source unit 111 for supplying supply and ground voltages to the first microprocessor 112. The first microprocessor 112 receives the supply voltage Vdd from the voltage source unit 111 via a second signal line L112 and a ground voltage Vss from the voltage source unit 111 via a third signal line L113.

The second and third signal lines L112 and L113 also extend through the hinge hole 131 of the hinge 130 so that it is connected to the external display device 200.

The first microprocessor 112, diodes D11 and D12 and resistors R1 and R2 constitute a control unit 100 for controlling the operation of the refrigerator.

Now, the configuration of the external display device 200 will be described.

The external display device 200 includes a second microprocessor 221 adapted to perform data transmission and reception with the first microprocessor 112 of the control unit 100.

The second microprocessor 221 receives serial data from the first microprocessor 112 at its input terminal Rx via the signal line L111. The second microprocessor 221 also outputs data at its output terminal Tx so that the output data is sent to the first microprocessor 112 via the signal line L111. Another output terminal INT is provided at the second microprocessor 221. An interrupt signal is output at the output terminal INT of the second microprocessor 221. Normally, the second microprocessor 221 outputs a high-level signal at its output terminal INT. When the second microprocessor 221 outputs data at its output terminal Tx or inputs data at its input terminal Rx, it inverts the signal output at its output terminal INT from a high level to a low level, thereby outputting an interrupt signal informing of the generation of an interruption.

The three input/output terminals Rx, Tx and INT of the second microprocessor 221 are coupled together at a node which is coupled to the first signal line L111 serving to transmit data between the second microprocessor 221 and the control unit 100.

The external display device 200 also includes buffers 222 and 223 for temporarily storing data output from the microprocessor 221, and a plurality of light emitting elements LED1' to LEDn' connected in a combined manner to ten data signal lines extending from the buffers 222 and 223.

For example, the light emitting element LED1' is coupled between the signal line E6 connected to a sixth output terminal of the buffer 222 and the signal line E7 connected to a first output terminal of the buffer 223. The light emitting element LED2' is coupled between the signal line E5 connected to a fifth output terminal of the buffer 222 and the signal line E7 connected to the first output terminal of the buffer 223.

Accordingly, the light emitting elements LED1' to LEDn' turn on selectively, to perform a light emitting operation, in accordance with parallel data output from the output terminals of the buffers 222 and 223 respectively coupled to the signal lines E1 to E10.

The external display device 200 further includes a buffer 224, and a plurality of keys K1' to Km' coupled between the buffer 224 and buffer 222. The buffer 224 is an element for sending, to the second microprocessor 221, data based on a key input generated by a key manipulation of the user. The keys K1' to K12' are connected to signal lines L11 and L12 between the buffers 222 and 224. For example, the key K2' is coupled between the line E6 connected to the sixth output terminal of the buffer 22 and the line E11 connected to a first input terminal of the buffer 224. The key K2' is coupled between the line E5 connected to the fifth terminal of the buffer 222 and the line E12 connected to a second input terminal of the buffer 224.

The external display device 200 further includes a plurality of diodes D1' to Dm' coupled between the lines E1 to E6 connected to the output terminals of the buffer 222 and the lines E11 and E12 connected to the input terminals of the buffer 224. The diodes D1' to Dm' serve to prevent backward current from being generated when signals from the keys K1' to Km' are applied to the buffer 224.

When one of the keys K1' to Km' is selected by the user, a key signal in the form of voltage is generated. This key signal is sent to the microprocessor 221 which, in turn, detects the selected key based on the key signal.

The second microprocessor 221 receives the supply voltage Vdd from the voltage source unit 111 via the second signal line L112 and the ground voltage Vss from the voltage source unit 111 via the third signal line L113.

As mentioned above, the second and third signal lines L112 and L113 extend through the hinge hole 131 of the hinge 130.

A control operation for the external display device having the above-mentioned configuration according to the first embodiment will now be described.

First, the procedure for displaying detect signals from the sensors S11 and S12 and the function being currently carried out in the refrigerator on the external display device 200 under the control of the first microprocessor 112 will be described.

Figure 4A:
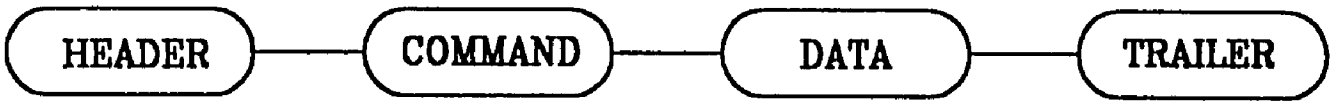
FIG. 4A is a diagram illustrating a format of data transmitted between the first and second microprocessors shown in FIG. 3.

The sensors S11 and S12 detect the temperature of the refrigerating or freezing compartment and other basic data to be used for desired controls. The detected data is received by the first microprocessor 112. Based on the detected data, the first microprocessor 112 determines the state of the refrigerator in accordance with an appropriately set program. Based on the determined state of the refrigerator, the microprocessor 112 drives the compressor 116 and fan motor 117, if desired. Where it is determined to drive a defrosting cycle, the microprocessor 112 drives the defrosting heater 18.

Where it is required to display desired information on the external display device 200 during the control operation of the first microprocessor 112, the first microprocessor 112 outputs associated data, which has a data format shown in FIG. 4A, at its output terminal Tx.

When the first microprocessor 112 outputs data at its output terminal Tx, the output signal, which is output at the output terminal INT of the first microprocessor 112, is inverted from a high level to a low level. That is, an interrupt signal is generated which informs of the outputting of data from the first microprocessor 112. This interrupt signal is sent to a main program of the first microprocessor 112 and the second microprocessor 221.

The serial data output from the output terminal Tx of the first microprocessor 112 is sent to the input terminal Rx of the second microprocessor 221 included in the external display device 200 via the signal line L111.

Based on the received serial data, the second microprocessor 221 determines what data should be processed and then carries out a desired control operation. For example, where the serial data input at the second microprocessor 221 is associated with a request for the light emission of selected light emitting elements, the second microprocessor 221 converts the input serial data into parallel data to be output at selected ones of its output terminals OUT1' to OUT10'. The output signals from the second microprocessor 221 are temporarily stored in the buffers 222 and 223 and then sent to selected light emitting elements.

Meanwhile, the second microprocessor 221 receives the supply voltage Vdd and ground voltage Vss from the voltage source unit 111 via the signal lines L112 and L113.

In accordance with the above-mentioned procedure, displaying of detect signals from the sensors S11 and S12 or the function being currently carried out in the refrigerator on the external display device 200 is carried out under the control of the first microprocessor 112.

That is, when a data transmission is carried out from the control unit 100 to the external display device 200 in order to display information associated with the detected refrigerating or freezing compartment temperature or the detected function execution condition, the first microprocessor 112 converts the detected basic information into serial data having the data format shown in FIG. 4A in accordance with the set program and then sends the serial data through a single signal line, namely, the signal line L111.

The second microprocessor 221 of the external display device 200 receives data from the first microprocessor 112 via the signal line L111 and analyzes the received data, thereby performing a signal processing such as a control for illuminating selected light emitting elements.

In order to achieve data transmission between the control unit 100 and external display device 200 through the single signal line L111, an additional signal processing procedure is used, as compared to the conventional configuration. That is, the data transmission according to the present invention is carried out by transmitting an information display command from the first microprocessor 112 to the second microprocessor 221 and then transmitting information from the first microprocessor 112 to the external display device 200 to display the information under the control of the second microprocessor 221.

Now, the data transmission procedure carried out between the first and second microprocessors 112 and 221 in accordance with a key activation in the external display device 200 will be described.

When the user selects an optional key on the external display device 200 (namely, the key is switched to its ON state), a current path is established in one of the lines E11 and E12, coupled to the input terminals of the buffer 224, through the selected key.

Meanwhile, the second microprocessor 221 periodically outputs data at its output terminals OUT1' to OUT10' in order to detect whether or not an optional key is selected by the user and what key is selected.

That is, signals output from the output terminals OUT1' to OUT10' of the second microprocessor 221 are transmitted to the keys via the buffers 222 and 223. When an optional key is in its ON state in accordance with a key selection by the user, the signal transmitted to the key is sent to the buffer 224 via the line E11 or E12 connected to the key. This data input at the buffer 224 is then sent to the second microprocessor 221. Thus, the second microprocessor 221 detects the key selected by the user.

After detecting the key selected by the user in the above-mentioned manner, the second microprocessor 221 outputs, at its output terminal Tx, data associated with the detected key in the form of serial data having the format of FIG. 4A in accordance with a set program.

The serial data is sent to the input terminal Rx of the first microprocessor 112 via the signal line L111. The microprocessor 112 then determines the function requested by the input key signal, so that it executes an appropriate control.

That is, in order to transmit data, based on a key manipulated by the user from, the external display device 200 to the control unit 100, the second microprocessor 221 converts the input key data into serial data having the format of FIG. 4A in accordance with the set program and then transmits the converted data via the single signal line L111.

After receiving the data from the external display device 200 via the signal line L111, the first microprocessor 112 analyzes the received data, thereby executing a control for the refrigerator based on the input key signal.

As apparent from the above description, even for the control for the functions of the refrigerator based on the key manipulation by the user, the second microprocessor 221 detects what key is selected by the user. The second microprocessor 221 also converts the detected key data into serial data having the format of FIG. 4 and transmits the converted data to the first microprocessor 112 via the single signal line L111. Thereafter, the command requested by the user is executed under the control of the first microprocessor 112.

In order to detect the command, it is necessary to detect different portions of the serial data transmitted between the two microprocessors 112 and 221. For example, the header and trailer of the serial data should be detected.

FIG. 4A illustrates the format of data transmitted between the first and second microprocessors 112 and 221 shown in FIG. 3.

As shown in FIG. 4A, the data transmitted between the first and second microprocessors 112 and 221 consists of a header portion, a command portion, a data portion and a trailer portion. The header portion includes a null code indicative of an initiation of communication. The command portion includes a command for the communication. The data portion includes data appended to the command. This data may be in the form of ASCII codes so that it is distinguished from other control codes. The trailer portion includes a carriage return code indicative of a completion of communication.

Where data associated with a "request for detected temperatures" is transmitted between the microprocessors, a header and a trailer are located at the leading and trailing portions of the data, respectively. The command associated with the "request for detected temperatures" is located between the header and trailer of the data. In this case, there is no data appended to the command.

On the other hand, where data responding to the "request for detected temperatures" is transmitted, it basically includes a header, a trailer, and a command associated with, for example, an "indication of detected temperatures". In this case, data associated with the detected temperatures may be appended to the command.

Figure 4B:
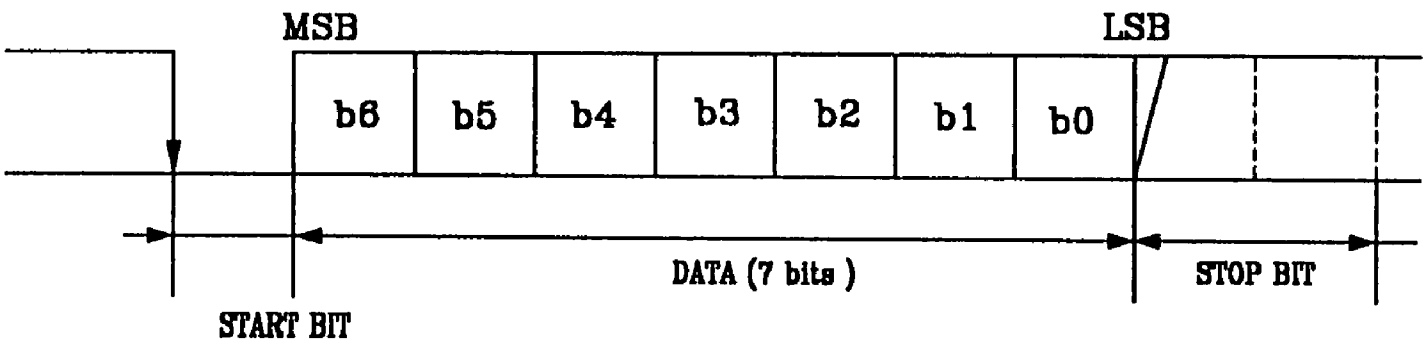
FIG. 4B is a diagram illustrating the bit string of each portion of data having the format of FIG. 4A.

FIG. 4B illustrates the bit string of each portion of data having the format of FIG. 4A.

As shown in FIG. 4B, each of the header, command, data and trailer parts of data has a main data portion of 7 bits and data portions respectively preceding and following the main data portion while being indicative of the leading and trailing ends of the main data portion. The transmission of such data may be carried out in the order starting from the most significant bit (MSB) or starting from the least significant bit (LSB).

As apparent from the above description, in accordance with the present invention, serial data having the format shown in FIGS. 4A and 4B is transmitted between the two microprocessors 112 and 221 via the single transmission line L111. Since the data being transmitted has the format shown in FIGS. 4A and 4B, there is no data collision during the transmission of the data between the microprocessors 112 and 221.

In order to prevent any data collision during the data transmission, it is necessary to selectively assign the right of data transmission to the microprocessors. In other words, the right of data transmission is assigned to a selected one of the microprocessors. After the transmission of data from the selected microprocessor is completed, the right of data transmission is assigned to the other microprocessor.

Figure 5A:
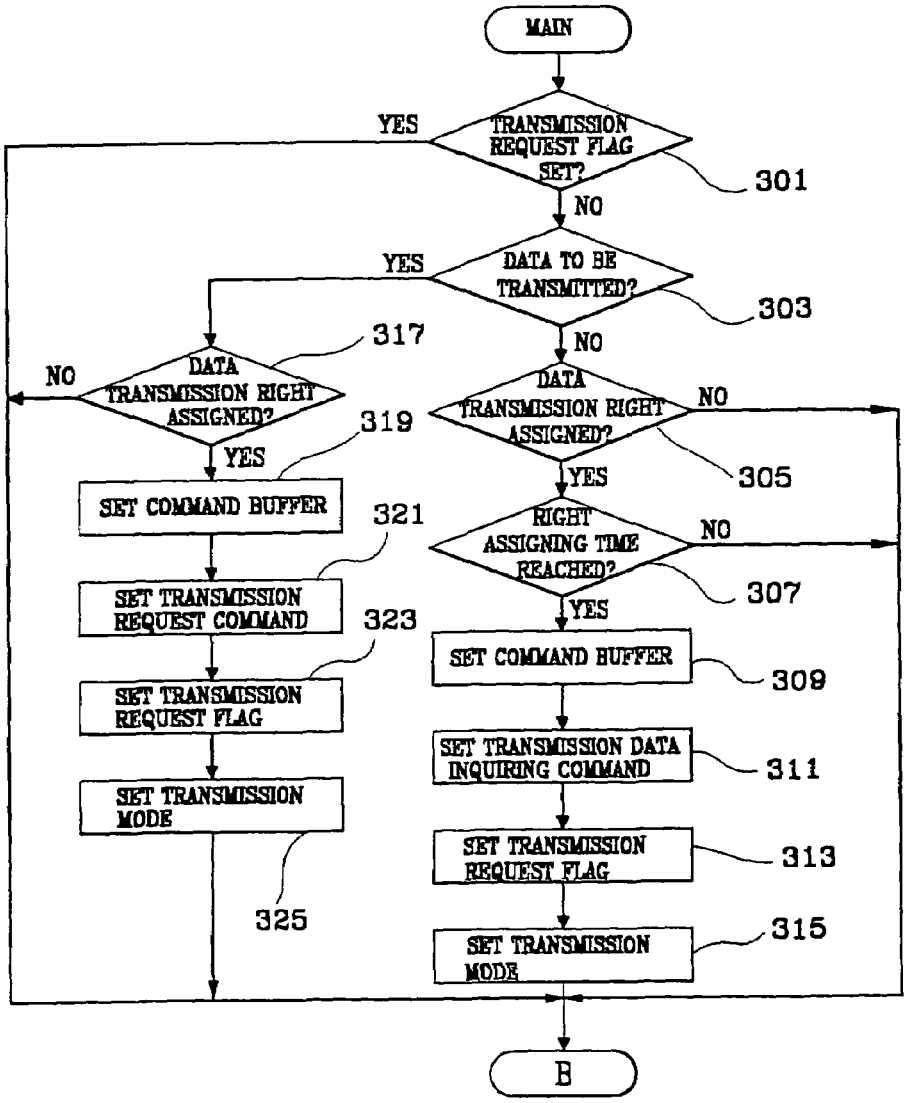
FIGS. 5A and 5B are flow charts illustrating a procedure for selectively assigning the right of data transmission to the first and second microprocessors of FIG. 3 in accordance with the present invention.

FIG. 5A is a flow chart illustrating the procedure for selectively assigning the right of data transmission to the first and second microprocessors of FIG. 3 in accordance with the first embodiment of the present invention.

In accordance with this procedure, it is first determined whether or not a transmission request flag is set in the subject microprocessor. That is, it is determined whether or not the subject microprocessor is in a transmission mode in which the subject microprocessor transmitting data to the counter microprocessor (Step 301).

Figure 5B:
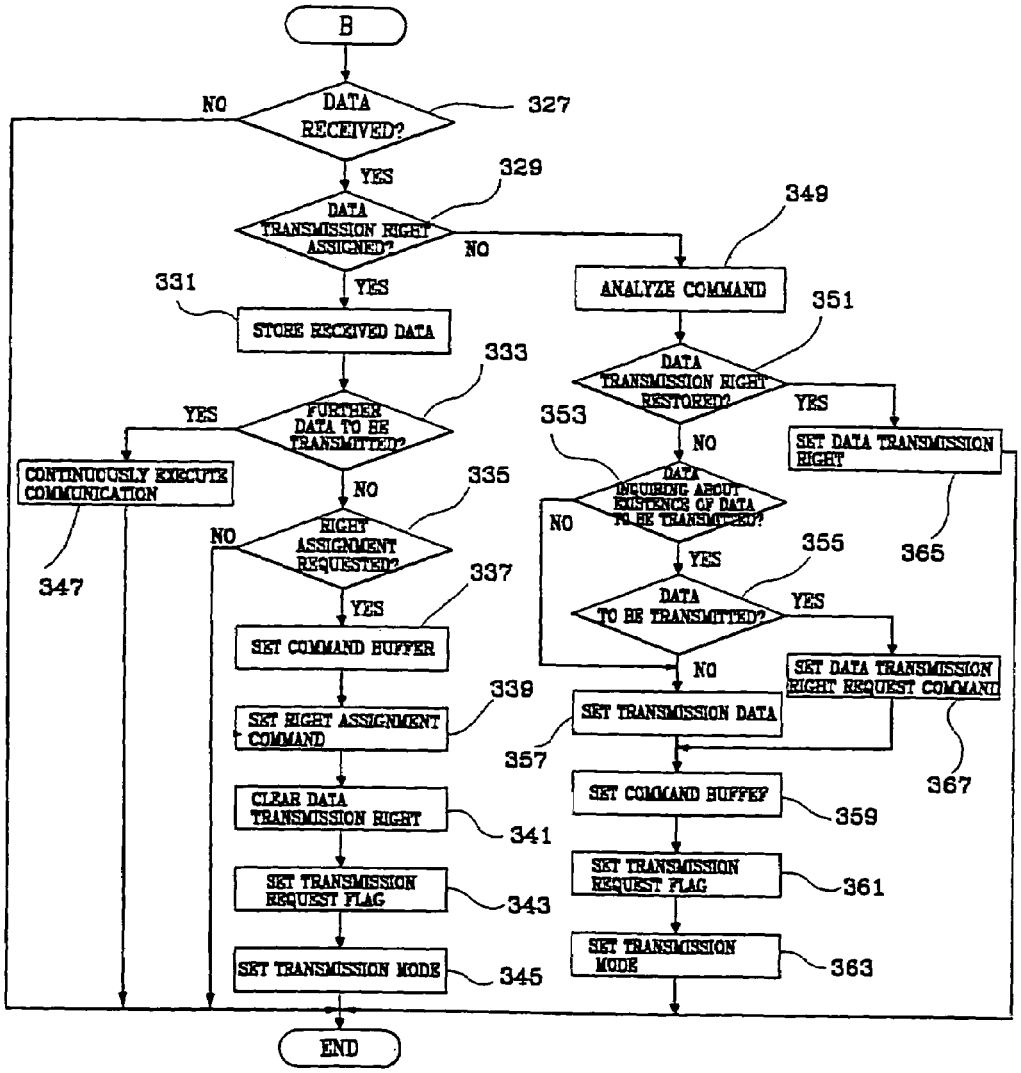
Figure 5C:
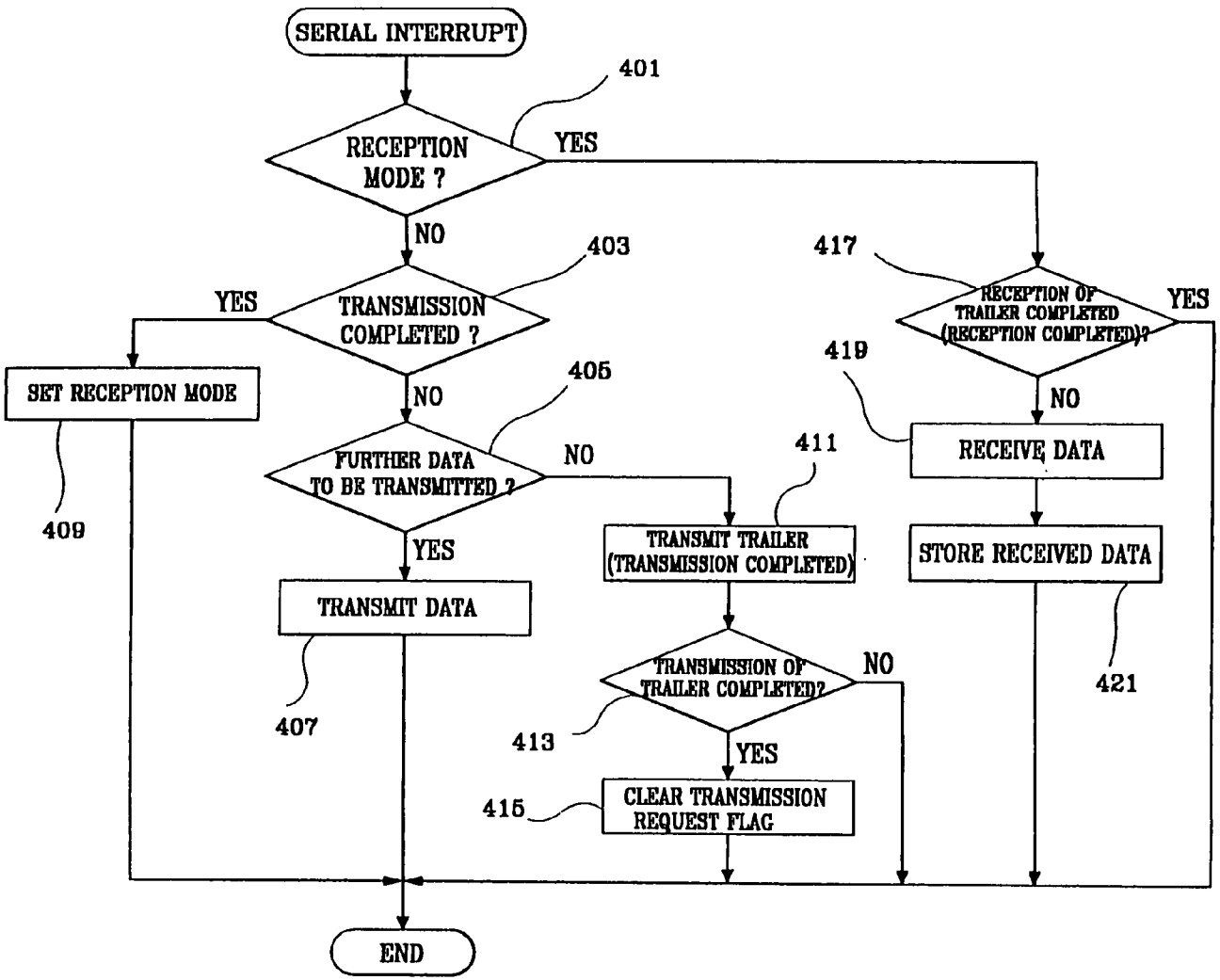
FIG. 5C is a flow chart illustrating direct data transmission and reception carried out between the first and second microprocessors shown in FIG. 3 in accordance with the embodiment of the present invention.

When it is determined at step 301 that a transmission request flag is set in the subject microprocessor, the subject microprocessor is maintained in the current state, namely, in the transmission mode, because the subject microprocessor is currently executing data transmission to the counter microprocessor in a serial interrupt mode as shown in FIG. 5C.

However, when it is determined at step 301 that no transmission request flag is set in the subject microprocessor, it is determined whether or not there is data to be transmitted from the subject microprocessor to the counter microprocessor (Step 303).

Where it is determined at step 303 that there is data to be transmitted, the subject microprocessor sets a condition for transmitting data to the counter microprocessor. In other words, the subject microprocessor determines whether or not there is a right of data transmission assigned thereto (Step 317). Where there is no right of data transmission assigned to the subject microprocessor, this state corresponds to the state in which the counter microprocessor is executing a data transmission. In this case, accordingly, the subject microprocessor waits until there is a right of data transmission assigned thereto.

When it is determined at step 317 that there is a right of data transmission assigned to the subject microprocessor, a buffer for temporarily storing data to be transmitted from the subject microprocessor is set (Step 319). Thereafter, a command and data to be transmitted are stored in the set buffer (Step 321).

The subject microprocessor then sets a transmission request flag informing the counter microprocessor of a data transmission from the subject microprocessor (Step 323). The subject microprocessor subsequently sets a transmission mode (Step 325). After setting the transmission mode, the subject microprocessor executes a transmission mode operation in the serial interrupt mode as shown in FIG. 5C.

On the other hand, where it is determined at step 303 that there is no data to be transmitted from the subject microprocessor to the counter microprocessor, it is determined whether or not the subject microprocessor has a right of data transmission (Step 305). Step 305 is necessary to prevent the subject microprocessor from depriving the counter microprocessor of the opportunity to transmit data due to the right of data transmission assigned to the subject microprocessor despite the fact that there is no data to be transmitted from the subject microprocessor.

When it is determined at step 305 that the subject microprocessor has no right of data transmission assigned thereto, it waits until there is data to be transmitted therefrom. When it is determined at step 305 that there is a right of data transmission assigned to the subject microprocessor, it is determined whether or not the current time corresponds to the point of time when the right of data transmission should be assigned to the counter microprocessor (Step 307).

Where it is determined at step 307 that the current time corresponds to the point of time when the right of data transmission should be assigned to the counter microprocessor, the subject microprocessor sets a buffer for temporarily storing data required in executing a data transmission procedure for the assignment of the data transmission right (Step 309). Data required to inquire of the counter microprocessor whether or not there is data to be transmitted is subsequently stored in the buffer (Step 311). Thereafter, a transmission request flag is set in the subject microprocessor to transmit the data stored in the buffer. After setting the transmission request flag, the subject microprocessor is set to its transmission mode (Step 315).

When the subject microprocessor is set to its transmission mode at step 315 or 325, the data stored in the buffer set at step 311 or 321 is transmitted to the counter microprocessor. This data transmission is carried out in the serial interrupt mode shown in FIG. 5C. This will be described in detail hereinafter.

Thus, where the subject microprocessor has data to be transmitted, it is set to its data transmission enabling state. Where there is no data to be transmitted from the subject microprocessor, the procedure for assigning the data transmission right to the counter microprocessor is executed.

After completing the above procedure, a procedure is executed to determine whether or not there is data received from the counter microprocessor to the subject microprocessor.

That is, it is determined whether or not there is data received from the counter microprocessor (Step 327). When there is no data received from the counter microprocessor, the subject microprocessor waits until there is data received from the counter microprocessor. When there is data received, a procedure for processing the received data is executed.

Where it is determined at step 329 that the subject microprocessor has a right of data transmission while it is determined at step 327 that there is data received from the counter microprocessor to the subject microprocessor, the data received at step 327 is a message responding to a request of the subject microprocessor.

In this case, accordingly, the received data is temporarily stored in an optional buffer (Step 331). In this state, the data communication is continuously executed. That is, it is determined whether or not there is data to be further transmitted (Step 333). When there is further data to be transmitted, the transmission mode of the subject microprocessor is maintained (Step 347).

Where it is determined at step 333 that there is no data to be further transmitted, from the subject microprocessor, it is determined whether or not the counter microprocessor requests an assignment of the data transmission right (Step 335). When the counter microprocessor requests an assignment of the data transmission right, a procedure for assigning the data transmission right to the counter microprocessor is executed. That is, a buffer for storing data required in executing the data transmission right assigning procedure is set (Step 337). Data associated with the request for the data transmission right assignment is then stored in the set buffer (Step 339). Thereafter, the subject microprocessor clears the data transmission right assigned thereto (Step 341) and then sets a transmission request flag (Step 343). Subsequently, the subject microprocessor sets its transmission mode (Step 345).

Where it is determined at step 329 that the subject microprocessor has no data transmission right while it is determined at step 327 that there is data received from the counter microprocessor to the subject microprocessor, the data received at step 327 is data optionally transmitted from the counter microprocessor. This data may be data associated with a certain command or simple data requesting no processing of certain data.

Accordingly, the received data is analyzed (Step 349). During the analysis, it is determined whether or not there is data associated with the assignment of the data transmission right from the counter microprocessor (Step 351).

Where it is determined at step 351 that there is an assignment of the data transmission right from the counter microprocessor, the data transmission right is assigned to the subject microprocessor (Step 365). On the other hand, where the received data corresponds to data inquiring whether or not the subject microprocessor has data to be transmitted (Step 353), it is determined whether or not the subject microprocessor requires a data transmission right for the data to be transmitted. Based on the result of this determination, an appropriate procedure is then executed.

That is, when it is determined at step 355 that the subject microprocessor requests an assignment of the data transmission right, a procedure is executed for temporarily storing a command associated with the request for the data transmission right in an optional buffer and then transmitting the command. This procedure involves step 367 and steps 359 to 363 sequentially following step 367.

However, where it is determined at step 355 that no data transmission right is required for the data to be transmitted, a procedure is executed for temporarily storing the data, to be transmitted, in an optional buffer and then transmitting the data. This procedure involves step 357 and steps 359 to 363 sequentially following step 357.

After completing the above-mentioned procedure, a desired processing for data received is executed. Now, a data transmission procedure directly executed in the data reception or transmission mode will be described.

FIG. 5C is a flow chart illustrating direct data transmission and reception carried out between the first and second microprocessors shown in FIG. 3.

The procedure shown in FIG. 5C is carried out under the condition in which a right of data transmission is assigned to the subject microprocessor in accordance with the procedure of FIG. 5B.

In accordance with the procedure of FIG. 5C, it is first determined whether the subject microprocessor is in its reception mode in which a reception of data is enabled (Step 401). Where it is determined at step 401 that the subject microprocessor is in its reception mode, it is determined whether or not a trailer, which is indicative of the trailing end of data, is received (Step 417).

Where it is determined at step 417 that no trailer is received, the reception of data is continued until the trailer is received (Step 419). The received data is then temporarily stored in the buffer set in the procedure of FIG. 5C (Step 421). When the trailer is received, the subject microprocessor waits for a subsequent data processing because the current state corresponds to the state in which the current data reception is completed.

On the other hand, where it is determined at step 401 that the subject microprocessor is not in its reception mode, it is determined whether or not transmission of data has been completed, because the operation mode of the subject microprocessor corresponds to a transmission mode (Step 403).

When it is determined at step 403 that the data transmission has been completed, the subject microprocessor is switched to its reception mode (Step 409). In the reception mode, the subject microprocessor monitors whether or not there is data received from the counter microprocessor. Where it is determined at step 403 that the data transmission has not been completed yet, it is determined whether or not there is data to be transmitted, in the buffer set in accordance with the procedure of FIG. 5A (Step 405).

When it is determined at step 405 that there is data to be transmitted, the data transmission is continued (Step 407). Where there is no data to be transmitted, a trailer is transmitted in order to inform of the completion of the data transmission (Steps 411 and 413). Thereafter, the subject microprocessor clears the set transmission request flag, thereby informing its main program and the counter microprocessor of the completion of its data transmission (Step 415).

In accordance with the above-mentioned procedure, it is possible to appropriately transmit/receive desired data between the first and second microprocessors 112 and 221 through the single data transmission line L111 without any data collision.

Figure 6A:
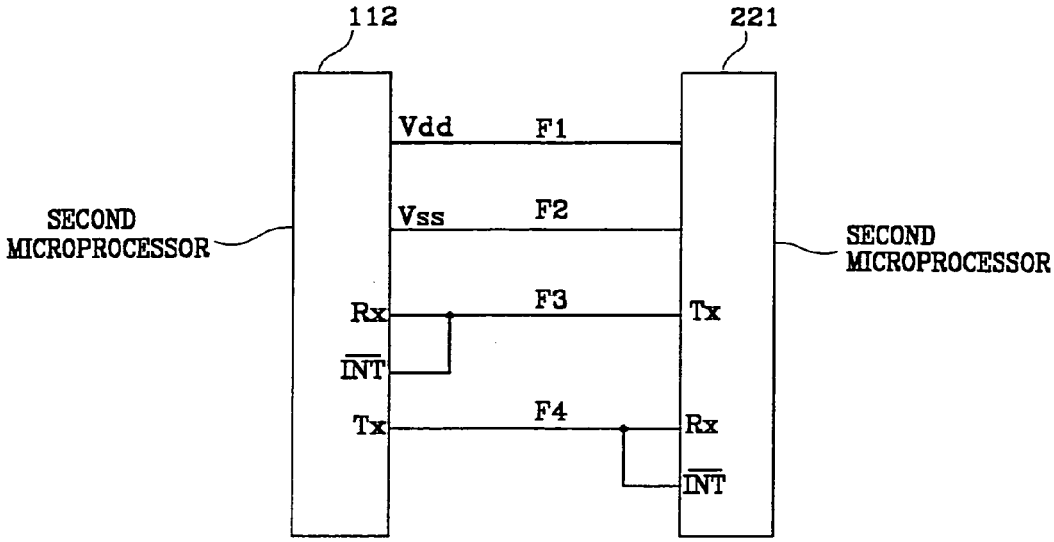
FIG. 6A is a block diagram illustrating a system for connecting the control unit of the refrigerator and external display device in an asynchronous four-wire manner in accordance with a second embodiment of the present invention.

FIG. 6A is a block diagram illustrating a system for connecting the control unit 100 and external display device 200 in an asynchronous four-wire manner in accordance with a second embodiment of the present invention.

In this case, signal lines connected between the control unit 100 and external display device 200 include two lines F1 and F2 respectively adapted to supply the supply voltage Vdd and the ground voltage Vss, and two independent data input/output lines F3 and F4.

The first and second microprocessors 112 and 221 use, in common, the voltage input lines F1 and F2. The line F3, which is coupled to the data input terminal Rx of the first microprocessor 112, corresponds to the line coupled to the data output terminal Tx of the second microprocessor 221. On the other hand, the line F4, which is coupled to the data output terminal Tx of the first microprocessor 112, corresponds to the line coupled to the data input terminal Rx of the second microprocessor 221.

The output of the interrupt terminal INT of each microprocessor, which is inverted from a high level to a low level when the microprocessor transmits data, is coupled to the line connected to the input terminal of the microprocessor.

Figure 6B:
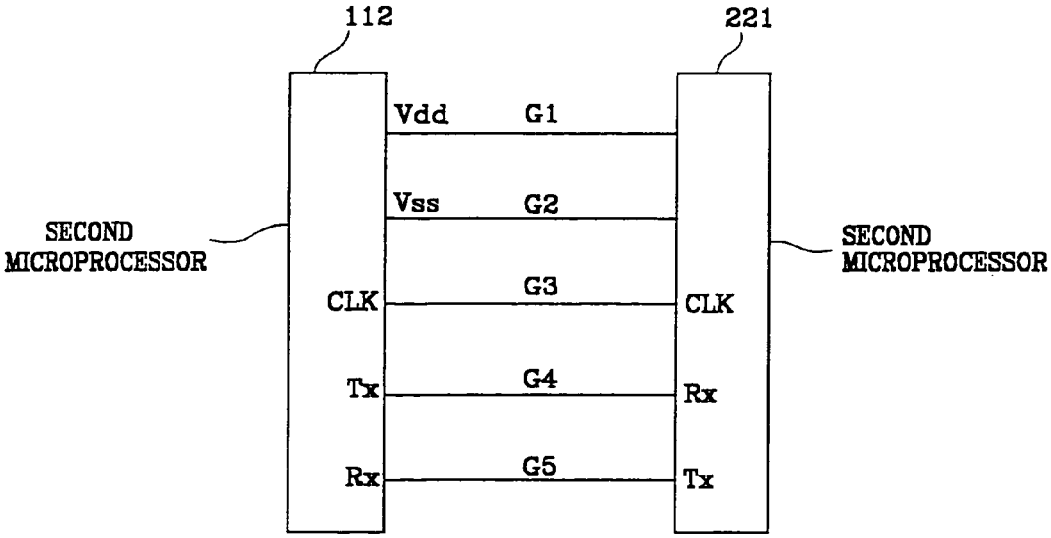
FIG. 6B is a block diagram illustrating a system for connecting the control unit of the refrigerator and external display device in a synchronous five-wire manner in accordance with a third embodiment of the present invention.

FIG. 6B is a block diagram illustrating a system for connecting the control unit 100 and external display device 200 in a synchronous five-wire manner in accordance with a third embodiment of the present invention.

In this case, the first and second microprocessors 112 and 221 use, in common, two voltage input lines G1 and G2. This system further includes a line G3 for outputting a clock signal adapted to provide a signal synchronization during a data outputting operation of each microprocessor, and two data input/output lines G4 and G5 connected in the same manner as the corresponding lines of FIG. 6A.

As apparent from the above description, these embodiment of the present invention provides an external display device of a refrigerator which includes a microprocessor enabling a serial data transmission/reception between the external display device and a control unit included in the refrigerator. The microprocessor of the display device is coupled with a microprocessor of the control unit by two voltage supply lines and a minimum number of data transmission lines. Data transmission/reception between the two microprocessors is carried out in an asynchronous or synchronous serial manner while using an appropriate data format so that each microprocessor recognizes the operation condition of the counter microprocessor. Accordingly, it is possible to simplify the configuration of signal lines required between the external display device and control unit, irrespective of the complexity of functions required.

By virtue of the simplified signal line configuration, it is possible not only to reduce the costs, but also to improve the workability required in passing signal lines through a hinge hole to couple the external display device to the control unit.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An external display device of a refrigerator comprising:

a display unit on a door in the refrigerator, showing information on the state of the refrigerator;

at least one user-select key on the door;

a sub control unit at the door, said sub control unit receiving and transmitting signals generated by pressing the key and controlling the display unit;

a main control unit at a main body of the refrigerator, said main control unit controlling operations of internal devices in the refrigerator and communicating with the sub control unit;

a hinge unit mounted on the refrigerator and supporting the door; and a communication means having a voltage supply line for supplying the supply voltage for the main control unit, the sub control unit and the display unit, and a signal line for transmitting data to each other, said communication means passing through the hinge unit, said sub control unit and said main control unit determining whether a right of data transmission is assigned to themselves before transmitting data to each other.

2. The device of claim 1, wherein the main control unit and the sub control unit communicate with each other in serial data transmission.

3. The device of claim 1, wherein the main control unit and the sub control unit communicate with each other in asynchronous serial data transmission.

4. A refrigerator comprising:

a body for holding food;

a door for covering an opening to said body;

a hinge connecting said body and said door;

a display unit mounted to said door for showing information on the state of said refrigerator;

at least one user-select key on said door;

a sub control unit physically connected to said door for controlling said display unit and for receiving signals generated by actuation of said at least one user-select key on the door;

a main control unit physically connected to said body, said main control unit connected to and controlling operations of a plurality of internal devices in said body, and said main control unit communicating with said sub control unit; and a communication channel connecting said main control unit and said sub control unit.

5. The refrigerator of claim 4, wherein said communication channel passes through said hinge.

6. The refrigerator of claim 4, wherein the main control unit communicates with said internal devices through wires.

7. The refrigerator of claim 4, wherein the main control unit communicates with the sub control unit through a wire.

8. The refrigerator of claim 4, wherein the sub control unit communicates with the display unit through wires.

9. The refrigerator of claim 4, wherein the main control unit and the sub control unit communicate with each other in serial data transmission.

10. The refrigerator of claim 4, wherein the main control unit and the sub control unit communicate with each other in asynchronous serial data transmission.

* * * * *